United States Patent [19]

LeJeune

[11] 4,171,778

[45] Oct. 23, 1979

[54] GRANULATOR ROTOR

[75] Inventor: Roland A. LeJeune, Cumberland, R.I.

[73] Assignee: Leesona Corporation, Warwick, R.I.

[21] Appl. No.: 882,211

[22] Filed: Feb. 27, 1978

[51] Int. Cl.[2] ..... B02C 13/28

[52] U.S. Cl. ..... 241/294; 241/191; 241/282.2

[58] Field of Search ..... 241/185 R, 188 R, 191, 241/197, 292.1, 282.2, 294, 300, 73

[56] References Cited

U.S. PATENT DOCUMENTS

| | | | |
|---|---|---|---|
| 1,699,944 | 1/1929 | Ball | 241/73 |
| 2,996,260 | 8/1961 | Carder | 241/191 |

*Primary Examiner*—E. F. Desmond

*Attorney, Agent, or Firm*—Robert J. Doherty

[57] ABSTRACT

The present invention relates to a rotor construction and particularly one in which the rotor includes a plurality of open-faced knife sets each having at least a pair of longitudinally spaced plates. At peripherally spaced locations between said plates, relatively heavy material contacting blocks are disposed. The blocks in turn provide a seat for a knife blade. Material fed to the chamber of a granulating machine in which such rotor is mounted, is contacted by the plates and the blocks with a pummelling action and by the knives in a cutting action. The material so pummelled and cut is thereafter free to pass immediately into open face portions or pockets disposed between the plates of each knife set. The material contacting faces of the plates and the blocks are provided with a hard faced surface. The rotor is referred to as being of "club-foot" construction.

5 Claims, 3 Drawing Figures

GRANULATOR ROTOR

BACKGROUND OF THE INVENTION

This invention relates to a rotor construction particularly adapted for use in size reduction equipment and has particular utility in the granulation of scrap wire. Such wire normally includes an interior metal conductor and an outer protective covering of resinous plastic or rubberlike composition in addition to fibrous material. In the granulation of such material, fibrous, resinous and other material fines are liberated. Irregular lengths of wire as well as such fines move about the chamber prior to their passing through screens for forming lower portions thereof, and accordingly may interfere with the material liberation action of conventional rotors.

Also, in the cutting or otherwise breaking of materials such as above described, the rotating knives become easily dull, chipped or otherwise damaged.

It is accordingly a primary object of the present invention to overcome such prior art difficulties through the provision of a rotor construction which contributes to the size reduction through impact with materials to be granulated and which utilizes hard-faced rotor surfaces so as to enhance the breaking or cutting action thereof.

Another object of the present invention is the provision of a rotor construction of the aforementioned type which furthermore permits partially cut or broken material being granulated to be temporarily received within interior portions of the rotor itself.

These and other objects of the present invention are accomplished by the provision of a rotor including a shaft and a plurality of knife sets disposed longitudinally therealong. The knife sets are progressively rotatably offset with respect to one another in relationship to their longitudinal disposition along the shaft and each formed by at least a pair of separated geometrically regular plates exhibiting a plurality of corners. A relatively heavy block longitudinally spans the distance between those spaced plates forming a knife set and the block in turn serves as a base from which a blade knife is disposed. Inasmuch as the space between the plates and the shaft is uncovered, a plurality of pockets corresponding to the number of corners of the plates are provided in which material may be received once contacted by the combination impact and cutting action afforded by the plate, block and blade portions respectively.

Other objects, features and advantages of the invention will become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
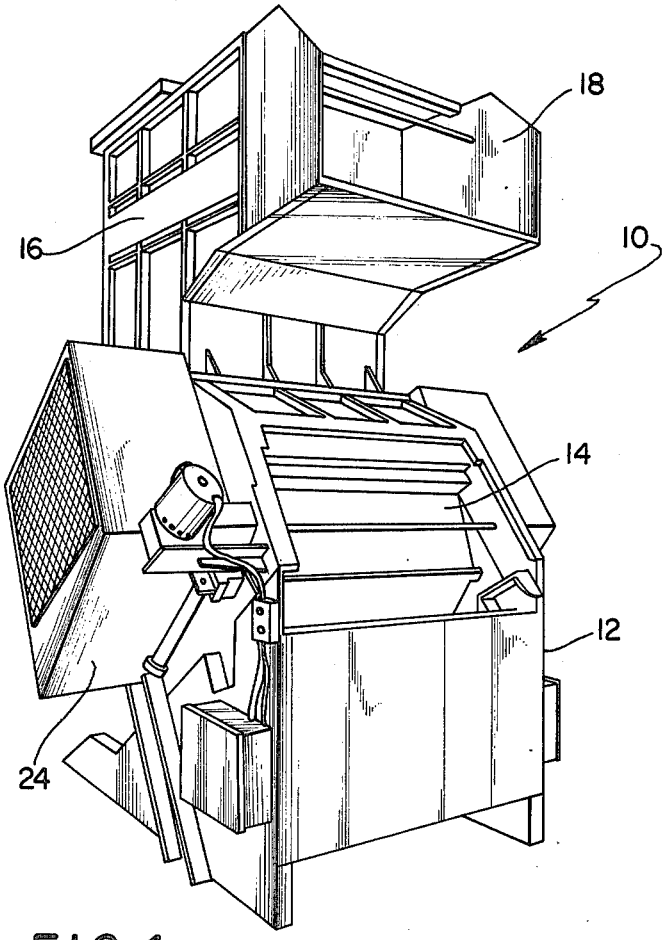
FIG. 1 is an overall perspective view showing a granulator in which the novel rotor construction of the present invention may be utilized.

Turning now to the drawing and particularly FIG. 1, there is shown a granulator identified by the reference numeral 10. This granulator may be the same as that manufactured and sold by Cumberland Engineering Company, Inc., Box 6065, Providence, Rhode Island 02940, as its Series C/Model 3250 Heavy Duty Granulator. The granulator 10 or other size reduction apparatus includes a base 12 in which a generally cylindrical cutting chamber 14 is disposed. The base furthermore supports a feed housing 16 having an inlet portion 18. A rotor, although not visible in FIG. 1, is mounted for coaxial rotation within the cutting chamber 14. The rotor is provided with cutting means which are adapted to coact with a stationary bed knife 20 in turn supported within the chamber 14 by a sidewall 22. More than one bed knife may be utilized and such may be either stationary or adjustable as is known. Furthermore, the lower portion of the chamber 14 may be defined by a removable screen such that the material in the chamber once reduced to the appropriate particle size, may pass therethrough for further processing. A motor 24 is utilized to power the rotor while other known equipment including safety and control features may be included as is known in the art.

Figure 2:
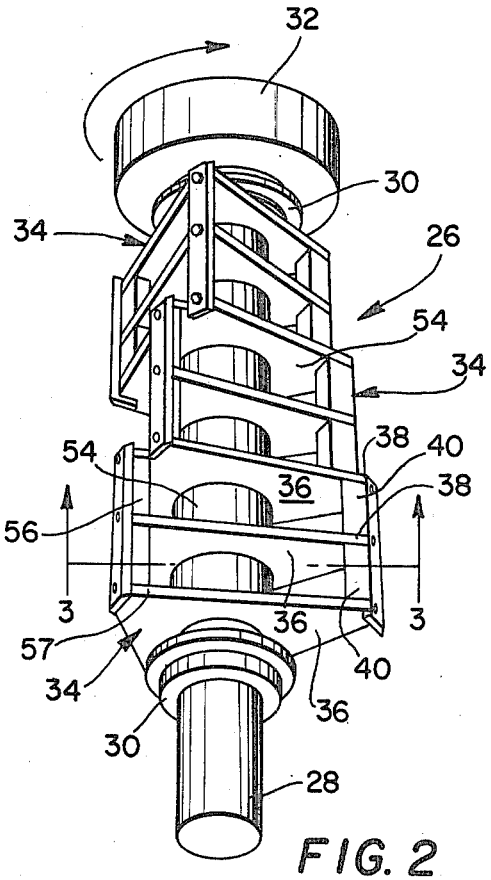
FIG. 2 is a perspective view of the rotor construction of the present invention.
Figure 3:
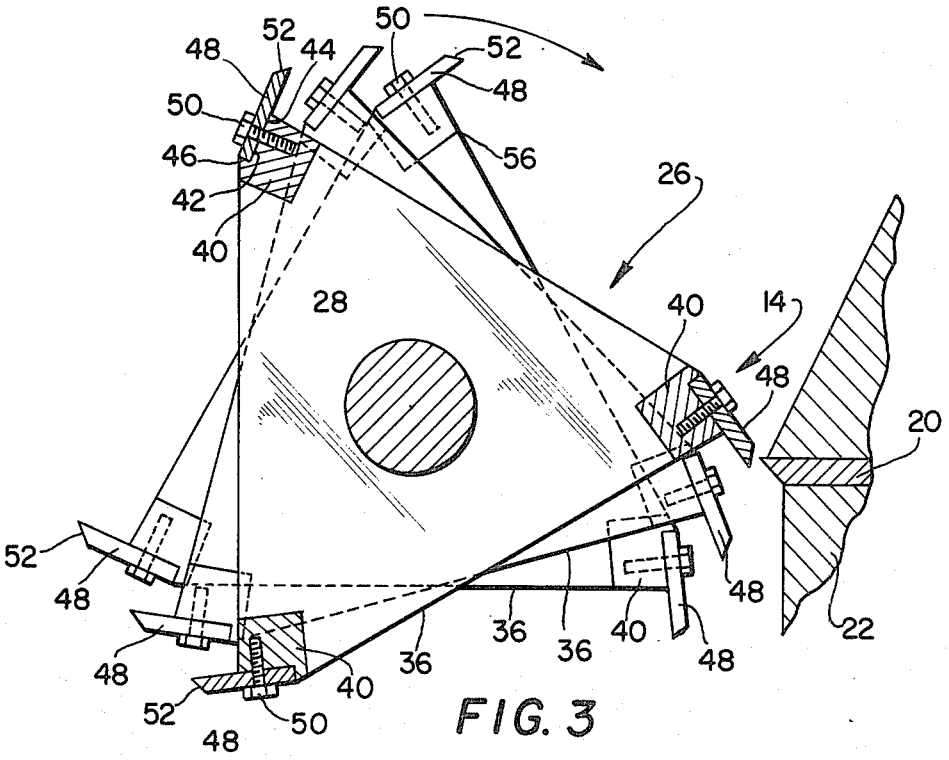
FIG. 3 is a sectional view thereof taken along the line 3—3 of FIG. 2, and additionally shows the rotational relationship of such a rotor with a fixed chamber bed knife illustrated to the right side thereof.

Turning now to FIGS. 2 and 3, the construction of the rotor 26 of the present invention is best shown. Such includes a cylindrical shaft 28 which is suitably journalled for rotation as by roller bearings 30 mounted on opposite ends thereof. Additionally, a fly wheel 32 is also mounted to the shaft 28 and sustains the rotational movement of the rotor 26 during operation. The shaft 28 of the rotor 26 is generally disposed coaxially within the cutting chamber 14.

A plurality of knife sets 34 are disposed longitudinally along the shaft 28, each of the sets being progressively rotated a greater amount relative to the shaft 28 as they longitudinally move from front to rear as shown in the drawing. Each knife set 34 includes at least a pair and generally three parallel plates 36 projecting radially outwardly from the shaft 28 and fixed thereto as by welding. The plates 36 are further preferably disposed in planes in turn disposed normal to the longitudinal axis of the shaft 28.

The plates are also of regular geometric configuration such as of the equilateral triangular shape shown in the drawing. Other configurations which the plates may assume include squares, rectangles and the like, it being clear that the number of sides of the plates determine the number of corners 38 thereof which in turn as will hereinafter be more clearly brought out, determines the number of cutting means mounted on each knife set 34. Thus, respective corners 38 of the plates 36 are disposed in longitudinally spaced disposition to each other and between such spaces, a relatively heavy block 40 is disposed and welded in place. Thus, if there are three plates 36 in each knife set 34, two blocks 40 will be utilized; however, in those cases where only two plates are utilized, one block is utilized. In any event, however, the block 40 is positioned between each of the corners 38 thereof and serves to stabilize and strengthen the construction of the knife set.

A longitudinally oriented slot 42 is formed in each of the blocks 40. The slot is positioned at the radial outer extent of the block 40 and thus presents adjacent face and heel surfaces 44 and 46 respectively for receipt of a blade 48 extending thereacross. The blade may be held in place by bolts 50 which extend through openings in the blade and in turn are threadably received within the block. The face 52 of the blade 48 is disposed so as to extend outwardly of the peripheral extent of the corners 38.

It should be further noted that the above-described knife set configuration in cooperation with the shaft 28 forms a plurality of pockets 54, each of open face construction and defined as that space between the plates 38 radially outwardly of the shaft 28. Thus it will be apparent that as the rotor 26 rotates, material within the chamber 14 is contacted thereby. The manner of such contact is such that materials and especially elongated materials such as wire and the like are not only cut by the cooperative action between the rotating blades 48 and the stationary bed knives 20, but further are free to contact the exposed edges or faces 56 of the blocks 40 and the exposed edges or faces 57 of the plates 36. Inasmuch as the blocks are heavy and the rotor is rotated at a high rate of speed, such impact action upon the material contacted produces a pummelling action found to be most satisfactory in the size reduction and liberation of wire-like products having an inner metallic conductor and an outer sheet of insulative material, that is, the separation of the primarily recycleable metal conductor from the insulative material.

The fines in the form of plastic or fabric particles and the like as well as irregular lengths of uncut or partially cut wire are free to temporarily accumulate in the pockets 54 and thus tend not to interfere with the impact and cutting action of the knife sets 34. The outer face surfaces of the blocks 40 and the plates 36 are hard faced, that is, treated so as to strengthen or harden those portions. Normally the plates and blocks are formed of steel and hardened by carborization such that the outer face surfaces thereof are of increased hardness so as to resist chipping or wear upon contact with the material being contacted.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A rotor construction including cutting means affixed thereto for use in a size reduction apparatus in turn including a chamber, means for mounting said rotor in said chamber for rotation about an axis and bed knife means mounted for cooperative cutting relationship with said rotor cutting means as said rotor is driven about said axis to effect size reduction of material fed into said chamber, said rotor including a longitudinally oriented shaft having at least a plurality of at least pairs of longitudinally spaced plates each forming a knife set, said plates of regular geometric configuration and having a plurality of corners, said plates radially outwardly extending from said shaft so as to define a plurality of open box-like material receiving pockets corresponding to the number of said plate corners, a material pummelling block mounted between each set of longitudinally spaced plate corners thereby connecting said plates of each said set together, outer face portions of said plates and said blocks adapted to contact material fed into said chamber being hard faced, each of said blocks having a longitudinally oriented knife receiving slot disposed at the leading face thereof and a knife blade positioned in each of said slots thereof, such that material fed to said chamber is contacted by said blades and the outer hard faced surfaces of said plates and said blocks as said rotor rotates in said chamber, there being a plurality of longitudinally disposed adjacent knife sets, each adjacent set including the blades thereof being axially staggered from an adjacent set, adjacent knife sets further having a common plate, said common plate having a notch inwardly extending from each corner thereof, said notch forming a step for partial receipt of one end of the block extending across the adjacent knife set.

2. The rotor of claim 1, each said blades being positioned radially outward of its respective supporting block, said blocks accordingly positioned adjacent to and below their respective blades.

3. The rotor of claim 1, said blocks parallel to each other and said shaft.

4. The rotor of claim 1, said plates being of equilateral triangular shape, there being three knife sets.

5. The rotor of claim 1, said plates and said blocks being carburized hardened steel.

* * * * *